US007654769B2

(12) United States Patent
Herrmann

(10) Patent No.: US 7,654,769 B2
(45) Date of Patent: Feb. 2, 2010

(54) METHOD AND REGULATING SYSTEM FOR PRODUCING A COVER LAYER

(75) Inventor: Jens Herrmann, Mannheim (DE)

(73) Assignee: Joseph Voegele AG, Mannheim (DE)

( * ) Notice: Subject to any disclaimer, the term of this patent is extended or adjusted under 35 U.S.C. 154(b) by 0 days.

(21) Appl. No.: 12/191,624

(22) Filed: Aug. 14, 2008

(65) Prior Publication Data

US 2009/0047069 A1 Feb. 19, 2009

(30) Foreign Application Priority Data

Aug. 16, 2007 (EP) ..... 07016122

(51) Int. Cl.
*E21C 35/08* (2006.01)
*E01C 21/00* (2006.01)

(52) U.S. Cl. ..... 404/75; 404/84.2; 404/118; 299/1.9

(58) Field of Classification Search ..... 404/83–86, 404/118; 299/1.9
See application file for complete search history.

(56) References Cited

U.S. PATENT DOCUMENTS 5,752,783 A * 5/1998 Malone ..... 404/84.2
6,352,386 B2 * 3/2002 Heims ..... 404/84.5
6,749,364 B1 * 6/2004 Baker et al. ..... 404/84.5
6,916,071 B2 * 7/2005 Harman et al. ..... 299/19
7,172,363 B2 * 2/2007 Olson et al. ..... 404/75

FOREIGN PATENT DOCUMENTS

DE 3823917 1/1990
DE 19647150 5/1998
DE 10025462 12/2001

* cited by examiner

*Primary Examiner*—Raymond W Addie
(74) *Attorney, Agent, or Firm*—Darby & Darby P.C.

(57) ABSTRACT

According to a method for constructing a cover layer S on a planum M by using a paving screed B the elevation of the paving screed B above the planum M is measured using a reference RZ on the planum M by at least one elevation sensors H and/or the lateral inclination of the paving screed B with respect to the planum M is measured by at least one lateral inclination sensor N. Upon occurrence of a deviation from the target elevation pulling points P of pulling bars 6 of the paving screed B are displaced vertically at a road paver F by levelling cylinders Z. Each levelling cylinder Z is exclusively adjusted over an absolute stroke starting from a selected zero point NP. The absolute stroke is calculated from a measuring result of a reference measurement and by consideration of a construction ratio factor. A new adjustment position of the levelling cylinder Z resulting from the adjustment over the absolute stroke in a self-learning fashion automatically is selected as the new zero point NP for a subsequent regulation cycle.

4 Claims, 1 Drawing Sheet

METHOD AND REGULATING SYSTEM FOR PRODUCING A COVER LAYER

Figure 1:
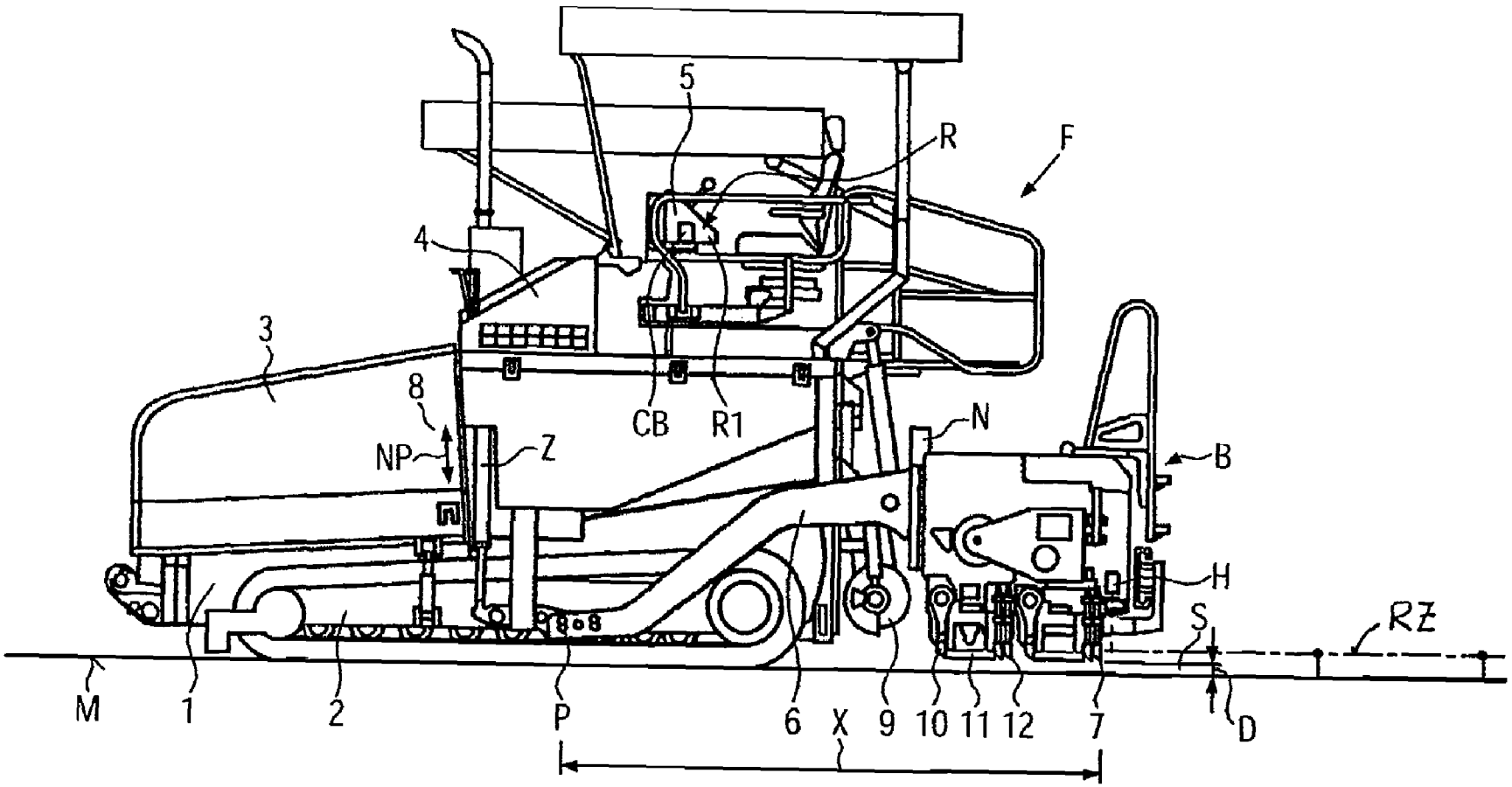

The invention relates to a method for constructing a cover layer on a planum with a paving screed towed at pulling bars by a road paver and to a regulating system for adjusting the elevation position and/or lateral inclination position of a paving screed of a road paver to a target value of the elevation or the lateral inclination relative to a planum during a construction cycle of a cover layer.

In practice various methods exist for correcting the thickness of a cover layer when constructing traffic surfaces.

According to a known method elevation sensors are installed at the front of the paver, at the rear end of the road paver close to the lateral distribution device, and at the paving screed and, in some cases, at the pull bars of the construction convoy. The elevation sensors are used for measuring the thickness by scanning the reference (e.g. a routing wire or by means of skids sliding on the planum). The levelling cylinders then respectively are adjusted in the respective direction depending on a detected deviation (thickness too thin or too thick) for such a time until the target thickness of the cover layer is reached again. The large number of elevation sensors results in high costs and a sophisticated signal processing.

According to another known method and in the case of a detected deviation the resulting height correction is evaluated relative to the respective levelling cylinder, e.g. with a view to the necessary adjustment direction of the levelling cylinder, and then the levelling cylinders are controlled for a time until the height deviation has been reduced to zero. Although sometimes the detected height deviation has a minimum value only, a levelling cylinder piston might travel until it is blocked in the cylinder, but then the deviation of the thickness cannot be corrected properly. By the placements of the elevation sensors a compromise is made between preciseness and evenness by providing several elevation sensors in the region between the rear edge of the paving screed and the levelling cylinders, and, in some cases, in the region of the lateral distributing device. The preciseness of the thickness of the layer, however, is hardly satisfactory despite the plurality of elevations sensors. Parameters which influence the construction of the cover layer like the construction speed, the temperature of the paving material, the compaction as generated, the consistency of the paving material, and the like, deteriorate the preciseness of corrections and complicate an accurate measurement of the thickness.

According to a method known from DE-A-10 02 5462 for determining the thickness of the layer an elevation sensor and a longitudinal inclination sensor are provided at each side of the paving screed at a pull bar. The elevation sensor measures the height difference with respect to the reference. The longitudinal inclination sensor measures the longitudinal inclination between the rear edge of the paving screed and the placement position of the elevation sensor. Based on a differential measurement value measured in the case of a deviation from a target thickness of the cover layer a target changing value of the longitudinal inclination is derived and compared to a target value of the longitudinal inclination in order to gain a control signal for a separate pulling point controller. The pulling point controller then adjusts the levelling cylinder for as long as necessary until the angle measured by the longitudinal inclination sensor reaches the target value. A construction ratio factor is not considered, but an imaginary calculation quantity which depends on the calculated angle between the rear edge of the paving screed and the placement position of the elevation sensor. As the levelling cylinder is controlled by the pulling point controller until the target inclination is reached, it cannot be excluded that the levelling cylinder reaches a blocked position. The position of the levelling cylinder will not be determined at any time.

According to a method known from DE-A-19 64 7150 for controlling the construction elevation of a paving screed an elevation sensor is provided at one side close to the rear edge of the paving screed and a longitudinal inclination sensor is provided at a pull bar, both scanning a reference on the planum. A height monitoring module is provided in order to generate a differential measuring value in case of a deviation from the target elevation. The differential measuring value then is input into a separate pulling point control loop and is then converted into a inclination changing value taken from a table. By means of the inclination changing value the angle of the longitudinal inclination monitored by the longitudinal inclination sensor then is brought to a longitudinal target inclination with the help of values taken from a table. This is executed such that the pulling point controller controls the levelling cylinder for such a time until the longitudinal target inclination is reached. The position of the levelling cylinder is not determined at any time. Furthermore, a construction ratio factor is not considered but instead an optimisation algorithm is used which depends in value on the fact of how rapidly a correction can be made or how strongly an over-correction is taking place. Since the pulling point controller controls the levelling cylinder for such a time until the longitudinal target inclination is reached, the levelling cylinder may become blocked.

It is an object of the invention to provide a method and a regulating system of the kind as mentioned in the first paragraph, both allowing to avoid with high accuracy construction failures caused by deviations from the target thickness of the layer. The method ought to be executed by a simple and rapidly responding regulating system.

This object is achieved by the features described below.

According to the method the measurement of the elevation is carried out as close as possible to the location of the paving screed which location is decisive for the accuracy of the thickness, namely at or in the direct vicinity of the rear edge of the paving screed, in order to precisely measure the construction elevation or the actual elevation with respect to the reference, and in order to immediately react in the case of an occurrence of a deviation from the target elevation. By the placement of the elevation sensor at or close to the rear edge of the paving screed and by the adjustment of the respective levelling cylinder only through a respectively predetermined absolute stroke, without allowing the levelling cylinder to reach a blocked condition, a very accurate and even construction of the cover layer can be carried out. Alternatively or additively at least one lateral inclination sensor at the paving screed is used which indirectly measures the elevation by means of the lateral inclination. Parameters which influence the construction like the construction speed, the temperature of the paving material, the generated compaction of the cover layer, the consistency of the paving material, and the like, are compensated for by the measurement of the elevation at the rear edge of the paving screed and/or the measurement of the lateral inclination at the paving screed, and by the adjustment of the respective levelling cylinder only through an absolute stroke. The respective zero point of the levelling cylinder is automatically learnt and is continuously corrected automatically as soon as the differential measurement value of the elevation sensor and/or of the lateral inclination sensor has been reduced to a minimum. This automatic learning process leads to the advantage that even an accidental false input construction ratio factor will lead to a correct result. The measurement of the lateral inclination, alternatively or additively, either leads to the same result, or assists the measurement of the elevation. A levelling cylinder adjustment position which results either from earlier learnt parameters or from adjusting the paving screed prior to the start of a construction cycle "manually" is selected and set as the zero point. An actual differential measurement value of the elevation sensor and/or the lateral inclination sensor, as then measured in relation to the reference, is set to zero. Then, during a construction cycle the actual elevation and/or actual lateral inclination is measured in relation to the reference. Upon occurrence of a deviation a new actual differential measurement value different from zero is determined by the evaluation sensor and/or by the lateral inclination sensor. By using the new actual differential measurement value and by considering the input construction ratio factor, which considers at least the lever arm between the pulling point and the reference measuring point, at which reference measuring point the sensor is measuring, an absolute stroke for the levelling cylinder is calculated as needed for the correction. Then, starting from the zero point the levelling cylinder is adjusted only over the calculated absolute stroke, and, in particular, in a direction, in which the new actual differential measurement value should become reduced to a predetermined minimum. It then is monitored during continued construction whether the predetermined minimum is reached. In the case that the predetermined minimum is not reached the prior set construction ratio factor is enlarged or reduced by means of a construction ratio controller which is designed such that it is able to learn how to operate accordingly. The construction ratio factor then is enlarged or reduced until the predetermined minimum of the differential measurement value is reached. As soon as the predetermined minimum is reached the new adjustment position of the levelling cylinder is taken as the new zero point. The predetermined minimum then is set to zero and is stored in the regulating system. Then the regulating system is ready for a new regulation cycle. According to this the regulating system operates such that it learns by itself and such that the correction is carried out relatively rapidly and precisely, and without danger that a levelling cylinder, in the case of e.g. a small regulation differential value, is moved too far and becomes blocked, due to a lack of a sufficiently useful regulation guiding quantity. In this case the deviation of the elevation would not be corrected at all or would be overcorrected.

The regulating system is simple, performs with a precise response behaviour, and operates with high reliability despite a surprisingly small number of sensors at the paving screed.

In the case that according to the method a cover layer ought to be constructed having a top surface which is sidewardly inclined relative to the planum, the zero points of both levelling cylinders at both sides of the road paver are set to different elevations, e.g. by using the lateral inclination sensor. This does not create a complication for the regulating system, because each regulating cycle is always executed starting from the zero point of the respective levelling cylinder without the necessity of considering the actual elevation adjustment position of the levelling cylinder.

Expediently, as the input construction ratio factor a constant ratio is selected between a stroke increment of the levelling cylinder and the lifting stroke or lowering stroke or lateral inclination stroke of the paving screed either as effected during the construction of the cover layer by or as to be expected by experience from the stroke increment at the reference measuring point, e.g. at or in the region of the rear edge of the paving screed.

The invention will be explained with the help of the drawing.

FIG. 1 is a side view of a construction convoy consisting of a road paver and at least one paving screed towed with pulling bars by the road paver.

The road paver F shown in FIG. 1 has a chassis 1 on an undercarriage and a paving material hopper 3 at the front end of the chassis 1. A primary driving source 4, e.g. a diesel engine, is mounted in the chassis 1 behind the paving material hopper 3. An operator's platform having a control console accommodating a computerised control device 5 is situated behind the primary driving source 4. A regulating system R either is incorporated into or is connected to the control device 5. The regulating system R or the control device 5 is equipped with a self-learning construction ratio controller R1, which then enlarges or reduces, i.e. increases or decreases an earlier input construction ratio factor for consideration by the regulating system R, e.g. when a thickness correction measure initiated by adjusting a levelling cylinder Z does not lead to a desired result, either at all or e.g. after a predetermined time duration. Furthermore, a calculating section CB is provided in the regulating system R. As conventional for road pavers, a so-called levelling system may be provided as well as a superimposed unit for controlling the operation of the paving screed B.

Levelling cylinders Z (e.g. double action hydraulic cylinders) are arranged at both sides of the road paver F substantially in the region of the longitudinal centre. The levelling cylinders Z serve for adjusting the elevation of pulling points P to which pull bars 6 are linked for towing a paving screed B. The paving screed B is fixedly mounted to the pulling bars 6. At least one lateral inclination sensor N may be installed at the paving screed B. The lateral inclination sensor N is linked to the control device 5 or the regulating system R. In some cases, the lateral inclination of the paving screed B may be varied by using the lateral inclination sensor N. At least one elevation sensor H is installed at one side at the paving screed B at or in the vicinity of a rear edge 7 of the paving screed (or elevation sensors H at both sides). The respective elevation sensor H measures as an elevation the vertical distance to a reference RZ which is installed on a planum M. The reference RZ e.g. is routing wire. In a not shown alternative the elevation sensor H measures with the help of a skid sliding on the planum M. When being controlled by the regulating system R the levelling cylinder Z adjusts the pulling point P respectively starting from an actual zero point NP and in directions as indicated by a double arrow upwardly or downwardly in order to either set and/or to correct a target thickness D of a cover layer S which is constructed by means of the paving screed B on the planum M. If provided, the lateral inclination sensor N measures the lateral inclination of the paving screed B relative to the planum M or relative to the reference RZ, respectively.

A lateral distributing device 9, e.g. distributing augers, is arranged between the rear end of the chassis 1 of the road paver F and the paving screed B. In the shown embodiment the paving screed B is a so-called extension paving screed the working width of which can be varied. A centre part of the paving screed and lateral movable extension screed parts have a respective sole plate 11, a tamper 10 in front of the sole plate, and a high-degree compacting assembly 12 including a single or several e.g. hydraulically actuated pressing bars.

A lever arm X between the pulling point P and a reference measuring point at which e.g. the elevation sensor H is measuring, in the shown embodiment a location at a rear edge 7 of the paving screed B, influences the so-called construction ratio. For this reason and according to the method of the invention (for a regulation e.g. in a closed regulation loop) a construction ratio factor considering this lever arm X is input into the construction ratio controller R1 or into the regulating system R or into the control device 6, respectively.

Prior to the start of a construction cycle the paving screed B is adjusted to the desired target thickness D of the layer, e.g. by putting planks below the paving screed B. In some cases, instead the paving screed B may be adjusted to the desired target thickness D by using parameters which have been determined beforehand or earlier. At the same time also the levelling cylinders Z are adjusted in order to adjust an attack angle of the paving screed and/or the lateral inclination of the paving screed which later will be towed floatingly while constructing a cover layer S. The attack angle and/or the lateral inclination then determine the target thickness D of the layer or the target elevation of the top surface of the cover layer S above a planum M. As soon as the adjustments are made, the momentary elevation position of the levelling cylinder Z is set as a levelling cylinder zero point NP in the regulating system R. The differential measurement value then measured by the elevation sensor H and/or by the lateral inclination sensor N by scanning the reference RZ on the planum versus a target value, also is set to zero.

Then a construction cycle is started. The road paver F is travelling while at the same time paving material (bituminous or concrete paving material) from the paving material hopper 3 is thrown on the planum by a conveying device (not shown) provided in the chassis. The paving material is thrown on the planum in front of the lateral distributing device 9, is distributed laterally and is then worked by the paving screed B. In the case that an elevation deviation (thickness of the cover layer S too thin/too thick) is detected during the construction cycle by the elevation sensor H and/or the lateral inclination sensor N, namely a deviation relative to the reference RZ, from the then determined differential measuring value an absolute stroke for the levelling cylinder Z is calculated in the regulating system R under consideration of the input construction ratio factor. The construction ratio factor considers how the height position of the paving screed B (or the thickness of the layer) is changed, e.g. at a rear edge 7 of the paving screed B, with a certain stroke increment of the levelling cylinder Z. When the thickness of the cover layer S increases, the attack angle of the paving screed B has to be set smaller. If the thickness of the cover layer S decreases versus the target thickness D, the attack angle of the paving screed B has to be adjusted steeper.

When during the construction cycle a deviation relative to a previously input or set target lateral inclination is measured by the lateral inclination sensor N, the deviation will result in a differential measurement value which then will also be calculated and converted into an absolute stroke of the levelling cylinder Z by the regulating system R under consideration of the input construction ratio factor.

After the deviation has been detected, the levelling cylinder Z only is adjusted through the calculated absolute stroke and starting from the selected zero point NP in the respectively needed direction. The absolute stroke is of such a magnitude that the levelling cylinder Z is unable to become blocked. By this adjustment the actual thickness of the cover layer S should become corrected towards the target thickness D of the layer S. Whether this will be achieved is monitored by further measurements by the elevation sensor H or the lateral inclination sensor N, until the differential measurement value becomes zero or a predetermined minimum. This confirms that the calculated absolute stroke of the levelling cylinder Z was correct. Then the new elevation position of the levelling cylinder Z is selected as a new zero point NP in the regulating system R. In the case of a further deviation occurring later the method is carried out again in the same way.

In the case that the expected predetermined minimum of the differential measurement value could not be reached after a predetermined time duration the previously set construction ratio factor is increased or decreased by the construction ratio controller R1 provided in the control device 6 or in the regulating system R, until the expected predetermined minimum of the differential measurement value is reached. The construction ratio controller R1 is designed such that it can learn by itself how much to change the factor.

If a cover layer S is to be constructed which has a lateral inclination relative to the planum M, both levelling cylinders Z are adjusted to different elevation positions. These different elevation positions are then selected as the zero points of the levelling cylinders Z. In this case the lateral inclination sensor N, co-operating with the control device 5 or the regulating system R, may be used, or in the simplest case a spirit level.

According to the invention at least one elevation sensor H is needed at or in the vicinity of the rear edge 7 of the paving screed B, in some cases, combined with the at least one lateral inclination sensor N. Alternatively, only the lateral inclination sensor N is needed at the paving screed, in some cases, combined with an elevation sensor H. Due to the small number of sensors H, N only a moderate amount of data has to be processed in the regulating system R.

During a correction the respective levelling cylinder Z executes an absolute stroke only starting at a selected zero point NP, meaning that the levelling cylinder Z will not just be extended or retracted until the deviation has been corrected. This assures that the levelling cylinder Z cannot inadvertently be adjusted too far and might become blocked such that then the deviation either would not be corrected at all or would be over-corrected.

The invention claimed is:

1. Method for laying a cover layer of a target layer thickness on a planum having a reference by use of a paving screed dragged by pulling bars of a road paver comprising:

measuring the elevation of the paving screed above the planum as a regulating differential value by at least one height sensor and/or at least one lateral inclination sensor provided in one of the road paver and the paving screed at or close to the rear edge of the paving screed;

transmitting the measured regulating differential value to a regulating system incorporated in a computer control device;

adjusting the respective pulling point of each pulling bar in the height direction by a leveling cylinder controlled by said control device for correcting the deviation upon occurrence of a deviation from the target layer thickness, wherein the adjusting step comprises:

executing correction of a leveling cylinder by adjusting starting from a selected leveling cylinder zero point over an absolute cylinder stroke without the stroke being brought to a stop, the absolute stroke being calculated on the basis of the measured regulating differential value and of an input laying condition factor of at least one of the lever arm between the pulling point and a reference measuring point, the reference measuring point corresponding to a location at the reference at which location at least one height sensor or lateral inclination sensor is measuring, and achieving a new leveling cylinder adjustment position resulting from the adjustment of the leveling cylinder over the absolute stroke selected in a self-learning fashion and automatically as a new leveling cylinder zero point for an upcoming subsequent regulation step;

prior to the start of laying a cover layer selectively taking a given leveling cylinder adjustment position as the leveling cylinder zero point on the basis of:

the paving screed set for the target thickness or by parameters previously stored in the regulating system, and the actual regulation differential value as measured relative to the reference of the at least one height sensor and/or of the lateral inclination sensor being set to zero corresponding to an absolute target value of the elevation, and/or the lateral inclination leveling cylinder adjustment position of the paving screed, measuring during laying the cover layer a new actual regulating differential value different from zero in case of deviation occurring and transmitting the new regulating difference value to the regulating system, calculating a new absolute stroke for the leveling cylinder on the basis of the new actual regulating differential value and under consideration of the input laying condition factor, before adjusting the leveling cylinder from the selected zero point exclusively over the calculated absolute stroke in a direction and in which direction the new actual regulating differential value is expected to be reduced to a predetermined minimum;

monitoring by continuous measurements during continued laying the cover layer reaching the predetermined minimum and either:

increasing or decreasing for further calculations of the respective absolute stroke by a self-learning laying condition regulator until the predetermined minimum of the regulating differential value is achieved as long as the predetermined minimum has not been reached the input laying condition factor, or selecting the new leveling cylinder adjustment position when the predetermined minimum is achieved as expected selected as a new leveling cylinder zero point and storing the new leveling cylinder adjustment position in the regulating system.

2. Method according to claim 1, wherein constructing a cover layer having a top surface being inclined laterally relative to the planum the zero points of both leveling cylinders are selected according to different elevation adjustment positions.

3. Method according to claim 1, wherein as the input construction ratio factor a constant ratio is selected between a stroke increment of the leveling cylinder and the lifting stroke or lowering stroke or lateral inclination stroke of the paving screed at the reference measuring point either resulting from the stroke increment or being expected from the stroke increment, and that the reference measuring point, preferably, is located at the rear edge of the paving screed or in close vicinity to the rear edge of the paving screed.

4. A regulating system for adjusting the elevation position and/or lateral inclination position of a paving screed of a road paver to a target value of the elevation or the lateral inclination relative to a planum having a reference during a construction cycle of laying a cover layer, comprising:

pulling bars for connecting the paving screed to pulling points at the road paver;

leveling cylinders which can be retracted and extended between blocking stops for vertically adjusting the pulling points;

at least one elevation sensor at or in the vicinity of the rear edge of the paving screed and/or a lateral inclination sensor installed at the paving screed, the respective sensor for measuring an elevation with respect to the reference on the planum or a lateral inclination for the paving screed relative to the reference at a reference measuring point spaced apart from the pulling point by a lever arm;

a regulating system with which the respective sensor for transferring differential measurement values is interlinked, wherein the regulating system comprises:

a calculating section for calculating an absolute stroke for a respective leveling cylinder on the basis of a differential measurement value measured at the reference measurement point starting from zero and of an input construction ratio factor considering the lever arm, the absolute stroke starting from a selected leveling cylinder zero point, and correcting a measured deviation from a target value; and a self-learning construction ratio controller for increasing or decreasing the input construction ratio factor on the basis of a failure of the initiated correction of the deviation.

* * * * *